US006336468B1

(12) United States Patent
Cords

(10) Patent No.: US 6,336,468 B1
(45) Date of Patent: Jan. 8, 2002

(54) CHEMICAL SUPPLY TUBE ISOLATION SYSTEM

(75) Inventor: Robert G. Cords, Santa Cruz, CA (US)

(73) Assignee: Diverseylever, Inc., Edgewater, NJ (US)

( * ) Notice: Subject to any disclaimer, the term of this patent is extended or adjusted under 35 U.S.C. 154(b) by 0 days.

(21) Appl. No.: 09/016,500

(22) Filed: Jan. 30, 1998

(51) Int. Cl.[7] ..... B08B 3/04; B08B 9/032; D06F 39/02

(52) U.S. Cl. ..... 137/239; 134/103.1; 134/104.1; 134/169 C; 134/171; 68/17 R; 68/207; 137/240; 137/266; 137/565.01; 137/15.05; 222/144.5; 222/148

(58) Field of Search ..... 134/103.1, 104.1, 134/94.1, 95.1, 98.1, 99.1, 99.2, 169 R, 169 C, 166 C, 171; 68/17 R, 207; 137/239, 240, 563, 266, 565.01, 565.15, 565.17, 565.39, 565.3, 15.05; 222/144.5, 148, 642, 651; 141/85, 89

(56) References Cited

U.S. PATENT DOCUMENTS

| | | | | | |
|---|---|---|---|---|---|
| 856,948 | A | * | 6/1907 | Fetta | 137/239 |
| 1,149,164 | A | * | 8/1915 | Richter | 134/103.1 |
| 2,029,232 | A | * | 1/1936 | Green | 134/103.1 |
| 2,526,286 | A | * | 10/1950 | Schwarzkopf et al. | 134/103.1 |
| 2,718,481 | A | * | 9/1955 | Tuthill | 134/103.1 |
| 2,827,070 | A | * | 3/1958 | Gatz | 137/239 |
| 3,154,087 | A | * | 10/1964 | Beaver | 137/240 |
| 3,258,792 | A | * | 7/1966 | Rickel | 137/563 |
| 3,572,366 | A | * | 3/1971 | Wiggins | 137/563 |
| 3,674,205 | A | * | 7/1972 | Kock | 137/240 |
| 3,982,666 | A | * | 9/1976 | Kleimola et al. | 68/17 R |
| 4,390,049 | A | * | 6/1983 | Albertson | 137/239 |
| 4,845,965 | A | * | 7/1989 | Copeland et al. | 68/17 R |
| 4,932,227 | A | * | 6/1990 | Hogrefe | 68/17 R |
| 5,014,211 | A | | 5/1991 | Turner et al. | 137/266 |

FOREIGN PATENT DOCUMENTS

| | | |
|---|---|---|
| EP | 480 490 | 4/1992 |
| EP | 787 849 | 6/1997 |

* cited by examiner

*Primary Examiner*—George L. Walton
(74) *Attorney, Agent, or Firm*—Pennie & Edmonds LLP

(57) ABSTRACT

A supply tube isolation system for use with a chemical delivery system includes a feedback tube connected between the manifold and each of the supply tubes connected between the chemical supply containers and the chemical pumps of the chemical delivery system. A controllable valve means is provided at or near the junction of the feedback tube and the supply tube so as to effectively segment the supply tube into first and second portions, where the first supply tube portion is that which is connected between the valve means and the manifold, and the second tube portion is that which is connected between the valve means and the chemical supply container. During delivery of the chemical to one or more destinations within the delivery system, the valve means is positioned so as to close the feedback tube and connect the first and second portions of the supply tube. During a subsequent flushing of the delivery system with water, the valve means is positioned so as to connect the first portion of the supply tube to the feedback tube and close the second portion of the supply tube. In this manner, water flushed through the manifold and chemical pump to remove chemical residue therein does not contact chemicals within the supply containers.

14 Claims, 4 Drawing Sheets

CHEMICAL SUPPLY TUBE ISOLATION SYSTEM

BACKGROUND

1. Field of Invention

This invention relates generally to chemical dispensing systems and specifically to a method and system for flushing chemicals from a liquid chemical delivery system.

2. Description of Related Art

Liquid chemical delivery systems are used to automatically deliver a plurality of viscous chemicals to one or more destinations. Examples of a liquid chemical delivery system having a single manifold and a single distribution tube and the advantages thereof are described in commonly owned U.S. Pat. No. 5,014,211, incorporated herein by reference. FIG. 1 shows a chemical delivery system 100 of the type disclosed in U.S. Pat. No. 5,014,211. When it is desired to deliver a chemical stored within the container 102 to, for instance, the washer 110, the chemical pump 142 is operated in a forward direction so as to pump the chemical from the container 102 into the manifold 130. The transport pump 132 pumps the chemical from the manifold 130 to the destination washer 110 via the feed tube 150. In some embodiments, the transport pump 132 has a larger pumping capacity than the chemical pump 142 and therefore draws water into the manifold 130 from the break tank 116 while pumping the chemical from the manifold 130 to the feed tube 150. In this manner, chemicals from the container 102 are diluted before being delivered to the washers 110–112.

After one or more chemicals are successfully delivered to the washers 110–112, it is desirable to flush the chemical pumps 142–146 with water to remove residual chemicals therein. Thus, after delivery of a chemical from the container 102 to the washer 110, the corresponding chemical pump 142 is operated in a reverse direction to pull water from the manifold into the chemical pump 142 and thereby remove any chemical residual within the pump 142. Minimizing the time that the pump 142 is exposed to chemicals sourced from the container 102 maximizes the useful life of both the chemical pump 142 and its associated pump tube.

In an industrial laundry system such as, for instance, system 100 of FIG. 1, it is desirable to use highly concentrated detergents in order to minimize storage and transportation costs. However, high concentration detergents such as, for instance, the commercially available detergent "CLAX Ultima," are non-ionic surfactant chemicals that tend to thicken or "gel" when exposed to water. Thus, flushing the chemical delivery system 100 with water immediately after a non-ionic surfactant detergent is delivered using the system 100 may be problematic. Specifically, water is likely to flow into the chemical supply containers 102–106, and therefore likely to come into contact with the detergent therein, while respective pumps 142–146 are operated in the reverse direction. The resultant gelling of a non-ionic surfactant detergent at or near the outlet of the containers 102–106 may not only compromise the proper concentration of the detergents therein but also lead to a blockage of that outlet and, thus, disrupt subsequent detergent flow from the supply containers 102.

Prior "solutions" to problems resulting from this "gelling" of non-ionic detergents are not entirely satisfactory. Some solutions simply avoid the use of chemicals that gel upon contact with water. This approach, however, undesirably limits the range of chemicals that may be used with the delivery system 100. Other solutions include using a non-flushed chemical injection system, or using steam injection systems, to flush the chemical pumps 142–146. These approaches, however, are complicated and expensive.

SUMMARY

A supply tube isolation system is disclosed for use with a chemical delivery system having a manifold connected to one or more chemical pumps which, in turn, are connected to corresponding supply containers via supply tubes. Present embodiments include feedback tubes connected between the manifold and each of the supply tubes of the delivery system. A controllable valve means is provided at or near the junction of the feedback tube and the supply tube so as to effectively segment the supply tube into first and second portions, where the first supply tube portion is that which is connected between the valve means and the manifold, and the second tube portion is that which is connected between the valve means and the supply container.

While one or more chemicals are being delivered to predetermined destinations within the delivery system, the valve means is positioned so as to allow a forward pumping action of the chemical pumps to effect chemical flow from corresponding supply containers to the manifold via the supply tubes and chemical pumps, and thereafter to the predetermined destinations via a feed tube. After the chemical is successfully delivered, the valve means is positioned so as to allow a reverse pumping action of the chemical pumps to draw water from the manifold into the chemical pumps and then back to the manifold via the first portions of the supply tube and the feedback tube. The second portions of the supply tubes are closed and thereby isolate the chemicals stored in the supply containers from the water. In this manner, present embodiments allow the chemical pumps and supply tubes of a suitable chemical delivery system to be flushed with water without exposing chemicals stored within the supply containers to water and, therefore, without an undesirable gelling of non-ionic surfactant chemicals.

Like components in the Figures are similarly labeled.

DETAILED DESCRIPTION

The present invention is described below in the context of the chemical delivery system 100 of FIG. 1 for simplicity only. It is to be understood that embodiments of the present invention are not limited to specific examples provided herein, but rather are applicable to other suitable chemical delivery systems. Further, although present embodiments are described below as delivering CLAX Ultima detergent, it is to be understood that present embodiments are suitable for use with the delivery of chemicals other than CLAX Ultima detergent.

As discussed above, since CLAX Ultima detergent gels when exposed to water, as do non-ionic surfactant chemicals, it is problematic to flush the delivery system 100 with water when the delivery system 100 is delivering CLAX Ultima detergent to the washers 110–112. Present embodiments alleviate this problem by isolating the supply containers 102–106 from the chemical pumps 142–146 and manifold 130 while the system 100 is flushed with water. Specifically, present embodiments employ feedback tubes between the manifold 130 and the supply tubes of the delivery system 100. Controllable valve means provided near the supply tube-feedback tube junctions allow the manifold 130 and chemical pumps 142–146 to be flushed with water while minimizing contact between water and the CLAX Ultima detergent (as well as other chemicals) stored in the containers 102–106. By sufficiently minimizing gelling of non-ionic surfactant detergents used within delivery system 100, present embodiments allow the system 100 to be used with a wider range of chemicals, thereby increasing its universality and, thus, its commercial potential. Further, present embodiments allow delivery systems such as the system 100 to take advantage of the low storage and transportation costs of highly concentrated detergents which, as mentioned above, are typically non-ionic surfactant chemicals.

Figure 1:
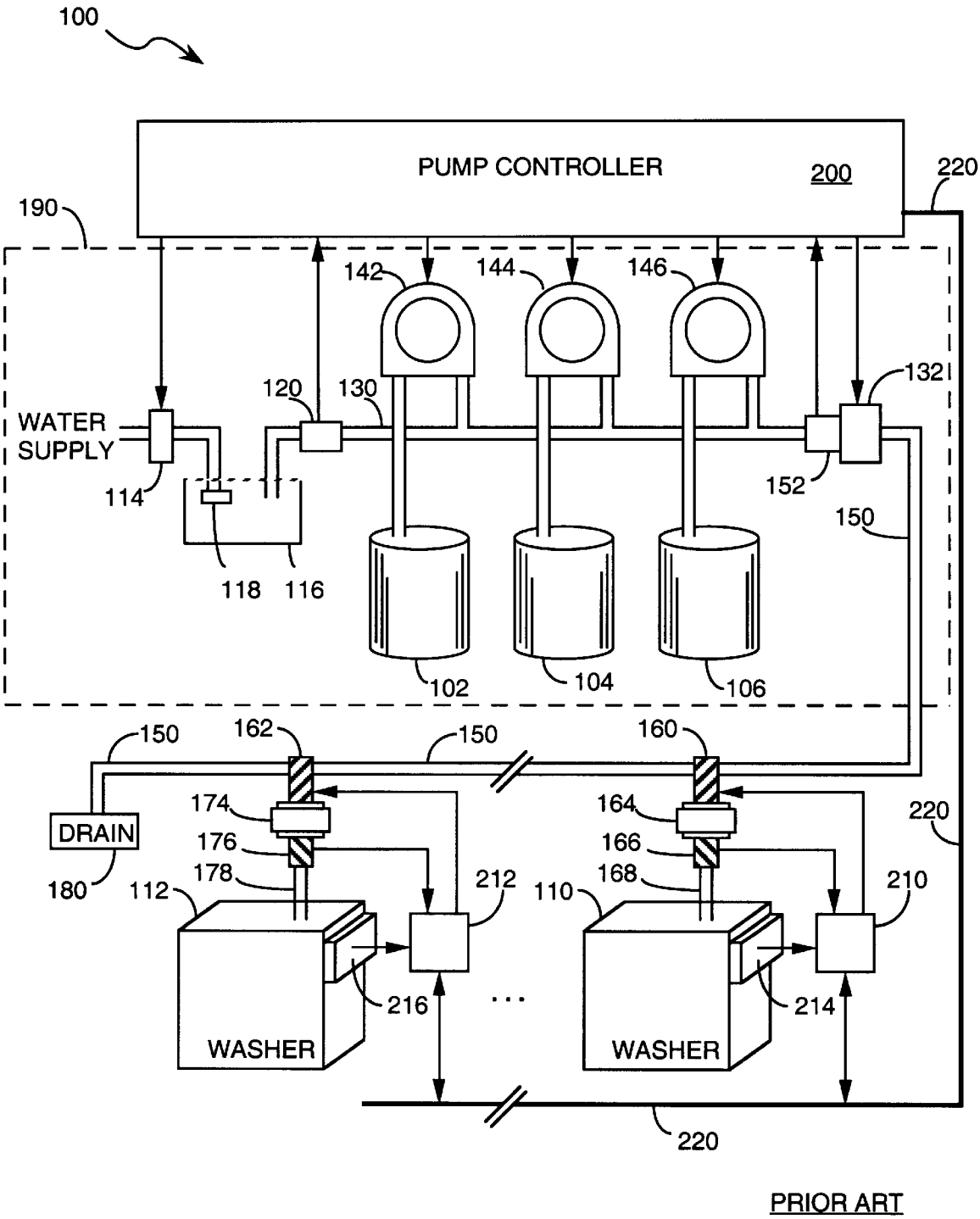
FIG. 1 is a block diagram of a chemical delivery system in accordance with the above-referenced U.S. Patent.
Figure 2:
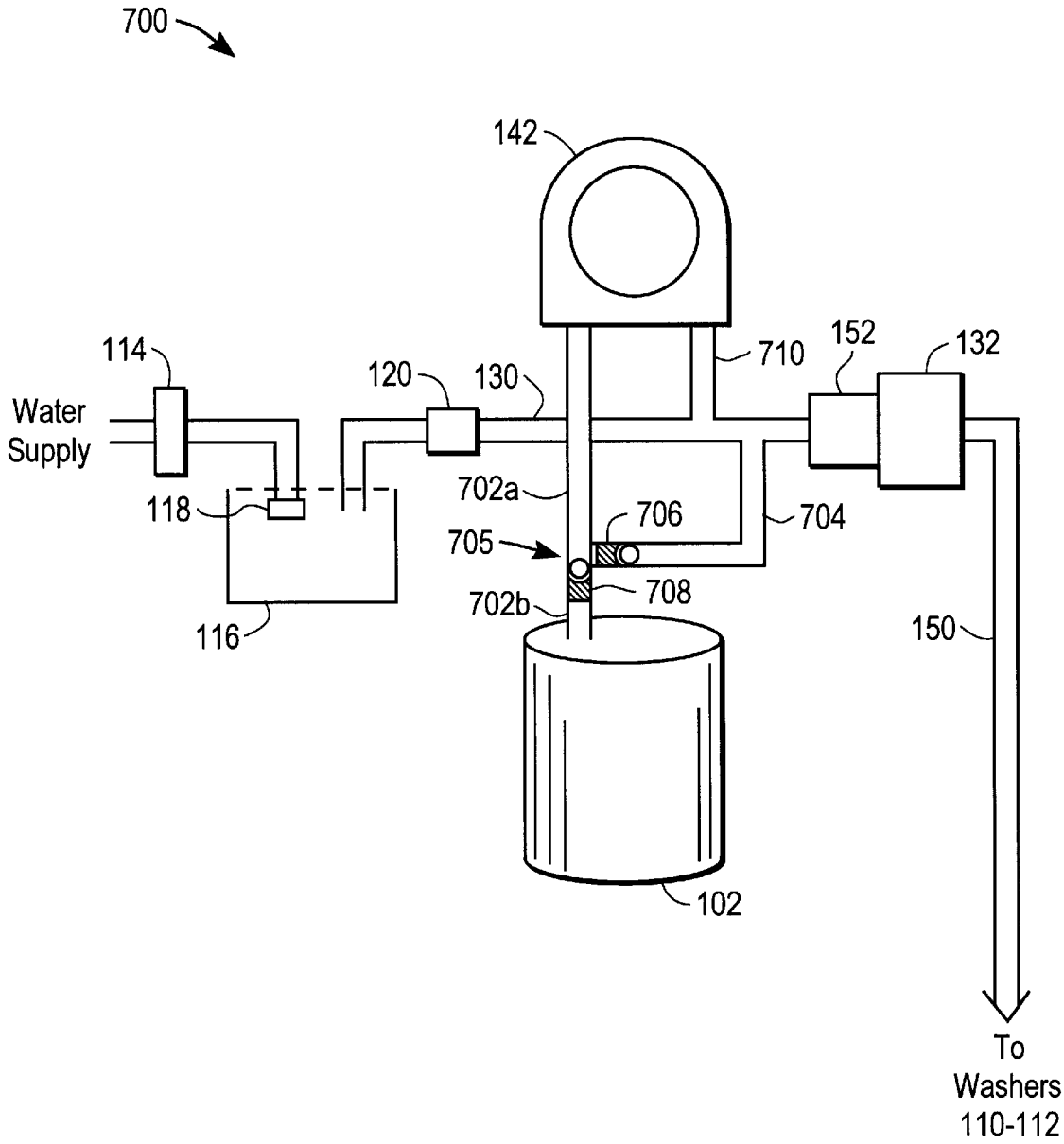
FIG. 2 is a block diagram of a supply tube isolation system in accordance with one embodiment of the present invention.

A supply line isolation system 700 in accordance with a first embodiment of the present invention is shown in FIG. 2. The isolation system 700 replaces portion 190 of the delivery system 100 of FIG. 1. Only one container 102 and its associated pump 142 of the isolation system 700 are shown in FIG. 2 for simplicity; actual embodiments may be employed in suitable delivery systems having a plurality of container-pump pairs. The isolation system 700 includes a pump supply tube 702 connected between the container 102 and the pump 142 and a feedback tube 704 connected between the manifold 130 and the pump supply tube 702. A first valve 706 is provided within the feedback tube 704 near its junction 705 with the pump supply tube 702. A second valve 708 is provided within the pump supply tube 702 between the junction 705 and the supply container 102, thereby segmenting the supply tube 702 into a first portion 702*a* between the manifold 130 and the junction 705 and a second portion 702*b* between the junction 705 and the supply container 102.

The supply tube isolation system 700 operates within the delivery system 100 of FIG. 1 as follows. During delivery of a chemical such as the CLAX Ultima detergent from the container 102 to one of the destination washers 110–112, the first valve 706 is in a closed position and the second valve 708 is in an open position. The chemical pump 142 is operated in a forward direction so as to pull the CLAX Ultima detergent from the container 102, through the supply tube 702 and the pump 142, and into the manifold 130. Referring also to FIG. 1, the transport pump 132 is operated in a forward direction to pump the CLAX Ultima from the manifold 130 to the destination washers 110–112. As discussed in U.S. Pat. No. 5,014,211, the flow capacity of the transport pump 132 is greater than that of the chemical pump 142 so as to dilute the CLAX Ultima within the manifold 130 by drawing water from the break tank 116. A conductivity cell 152 verifies that the chemical pump 142 has been primed and also verifies that the CLAX Ultima detergent is being successfully pumped from the supply container 102. Additional operational details of the delivery system 100 during this "delivery" phase are described in U.S. Pat. No. 5,014,211. As noted above, the first valve 706 is closed during the delivery phase, thereby precluding detergent flow to the supply tube 702 via the feedback tube 704.

After CLAX Ultima detergent is successfully delivered to the destination washers 110–112, the delivery system 100 enters a "flushing" phase during which, as described in U.S. Pat. No. 5,014,211, the manifold 130 and chemical pump 142 are flushed with water by running the chemical pump 142 in a reverse direction. During the flushing phase, first valve 706 is in an open position and the second valve 708 is in a closed position. Accordingly, when the pump 142 is run in the reverse direction, water drawn from the break tank 116 is pumped into the manifold 130 and then into the chemical pump 142 via the exit tube 710. The water exits the chemical pump 142 through the first supply tube portion 702*a*, enters the feedback tube 704 via the first valve 706, and is then removed from the manifold 130 by the transport pump 132 which, accordingly, continues to operate in the forward direction. In this manner, water from the break tank 116 flushes CLAX Ultima detergent residuals from the manifold 130 and the chemical pump 142 which, as mentioned above, advantageously prolongs the useful life of the chemical pump 142.

Since the second valve 708 is in the closed position during the flushing phase, water is precluded from coming into contact with CLAX Ultima detergent stored within the container 102, thereby greatly reducing the gelling of CLAX Ultima detergent near the outlet of the container 102. Indeed, the isolation system 700 results in a minimal amount of residual gelled detergent which, in turn, is pumped out of the delivery system 100 during subsequent delivery phases. Thus, including the isolation system 700 of FIG. 2 within the delivery system 100 of FIG. 1 allows the manifold 130 and chemical pump 142 of the system 100 to be flushed with water while nearly eliminating detergent gelling problems discussed above with respect to the prior art.

Preferably, the first and second valves 706 and 708 are non-return valves configured to open and close as described above in response to the pumping direction of the pump 142, i.e., the first valve 706 is closed and the second valve is open when the pump 142 operates in the forward direction, and the first valve 706 is open and the second valve 708 is closed when the pump 142 is operating in the reverse direction. The isolation system 700 is a passive system since external control signals are not required.

Figure 3A:
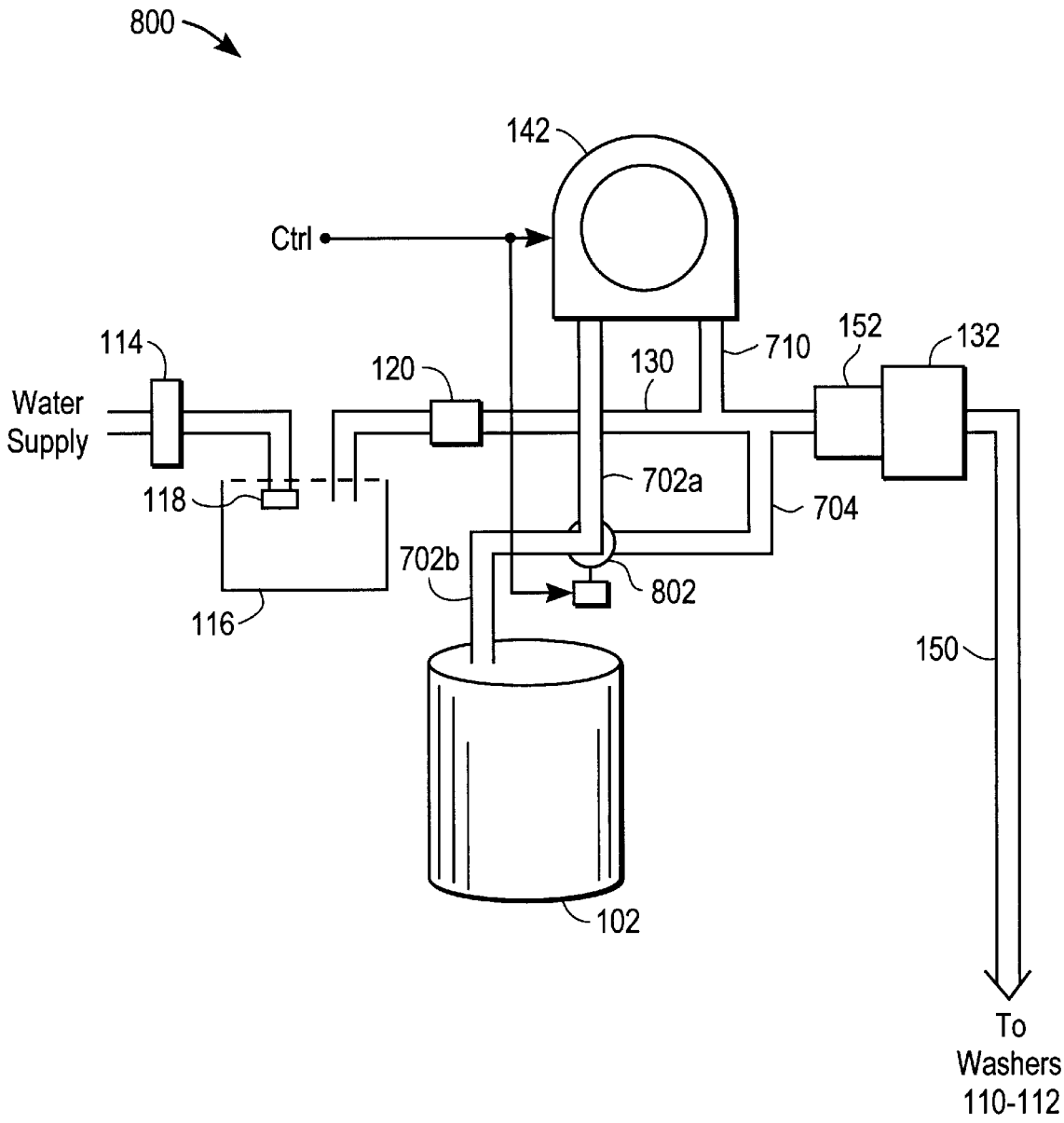
FIGS. 3A and 3B are block diagrams of a supply tube isolation system in accordance with another embodiment of the present invention.
Figure 3B:
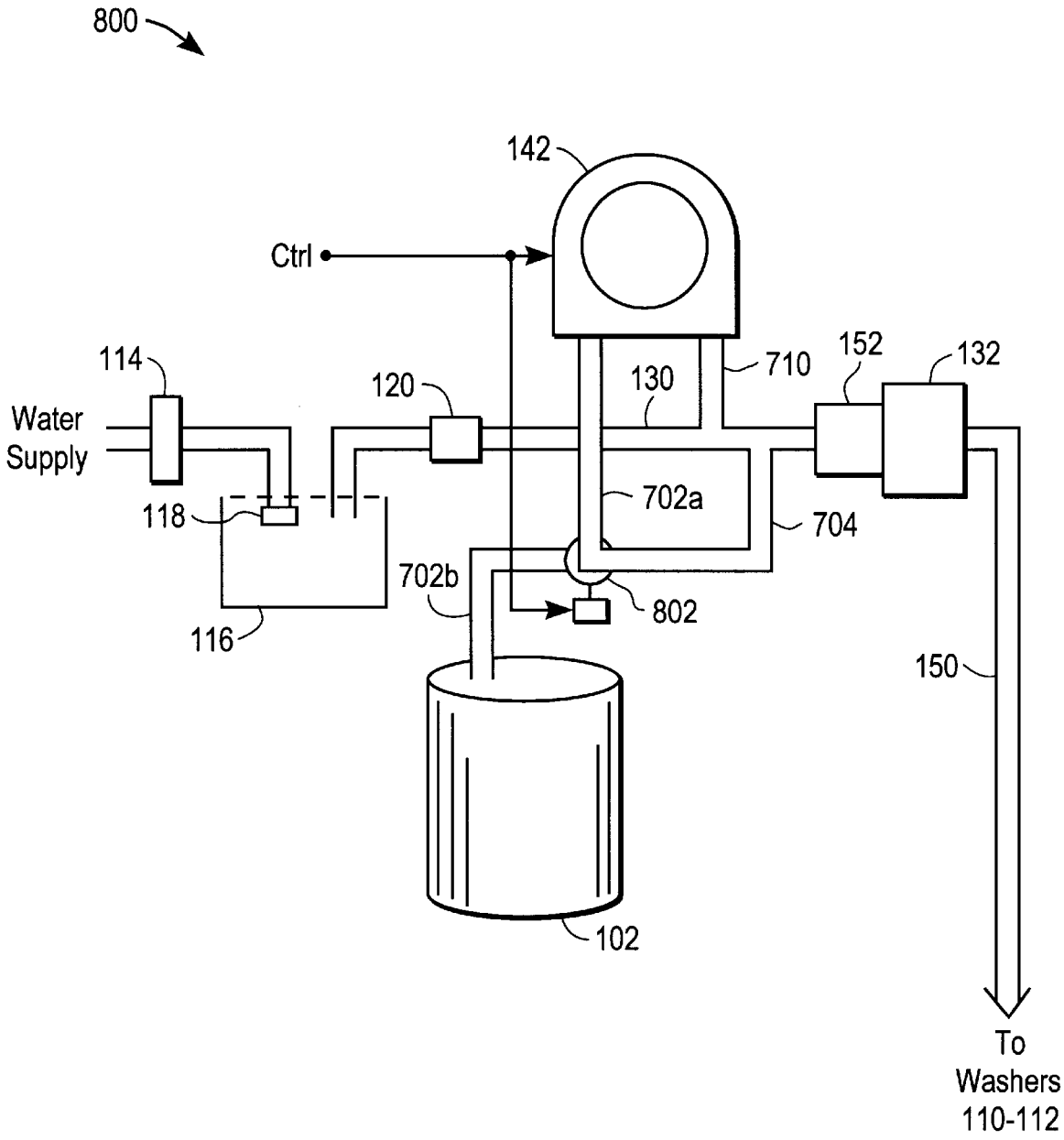

FIGS. 3A and 3B show an isolation system 800 in accordance with another embodiment of the present invention which may replace the portion 190 of the delivery system 100 of FIG. 1. Only one container 102 and chemical pump 142 pair are shown for simplicity. Here, the first and second valves 706 and 708 are replaced with a three-way, motor-driven ball valve 802. Specifically, the ball valve 802 is provided within the junction of the supply tube 702 and the feedback tube 704 and thereby segments the supply tube 702 into first and second portions 702*a* and 702*b*, respectively, as indicated in FIGS. 3A and 3B. The ball valve 802, which is of conventional design, selectively connects the first supply tube portion 702*a* to either the second supply tube portion 702*b* or to the feedback tube 704 in response to a control signal CTRL which, in some embodiments, also determines whether the chemical pump 142 operates in the forward direction or the reverse direction.

Prior to and during the delivery phase of the delivery system 100 (FIG. 1), the control signal CTRL is in a first state which causes the chemical pump 142 to operate in the forward direction. This first state of the control signal CTRL also forces the ball valve 802 to be positioned so as to connect the first supply tube portion 702*a* to the second supply tube portion 702*b*, as shown in FIG. 3A. Here, the feedback tube 704 is closed. In this manner, the forward pumping operation of the pump 142 draws CLAX Ultima detergent from the container 102, through the supply tube 702 and the pump 142, and into the manifold 130 for delivery to the destination washers 110–112 via the transport pump 132, as discussed above and more fully described in U.S. Pat. No. 5,014,211.

After completion of the delivery phase of the delivery system 100, the control signal CTRL transitions to a second state which, in turn, causes the chemical pump 142 to operate in the reverse direction and, in addition, changes the positioning of the ball valve 802 so as connect the first supply tube portion 702*a* to the feedback tube 704, as shown in FIG. 3B. Here, the second supply tube portion 702*b* is closed. In this manner, water drawn from the break tank 116 is pumped into the pump 142 via the exit tube 710 and then back into the manifold 130 via the first supply tube portion 702*a* and the feedback tube 704. Here, the ball valve 802 entirely precludes water from coming into contact with the CLAX Ultima detergent within the container 102. In this manner, the undesirable gelling of non-ionic surfactant detergents during the flushing phase is eliminated.

The embodiment depicted in FIGS. 3A and 3B is an active system in that external control signals, e.g., signal CTRL, are required to control the position of the ball valve 802. For applications where a complete elimination of detergent gelling is desired, the expense and complexity of the ball valve 802 (FIG. 3), as compared with the first and second non-return valves 706 and 708 of the passive system 700 (FIG. 2), is offset by the superior reduction in gelled detergent residue achieved by the active system 800, as compared to the passive system 700. Further, use of either the passive system 700 or the active system 800 eliminates the need for more expensive and complex flushing systems such as, for instance, steam injection flushing systems, thereby resulting in lower equipment cost associated with the delivery system 100.

While particular embodiments of the present invention have been shown and described, it will be obvious to those skilled in the art that changes and modifications may be made without departing from this invention in its broader aspects and, therefore, the appended claims are to encompass within their scope all such changes and modifications as fall within the true spirit and scope of this invention.

What is claimed is:

1. An isolation system for isolating a supply container from a supply tube connecting said supply container to a manifold of an associated chemical delivery system, said isolation system comprising:

a feedback tube having a first end connected to said manifold and a second end connected to said supply tube at a junction thereof;

a valve arrangement proximate to said junction for selectively connecting a first portion of said supply tube to either a second portion of said supply tube or to said feedback tube, said first portion of said supply tube connected between said valve arrangement and said manifold, said second portion of said supply tube connected between said valve arrangement and said supply container; and a pump located in-line along said first portion of said supply tube, between said valve arrangement and said manifold, for pumping in forward and reverse directions, where said valve arrangement is configured to be responsive to the pumping direction of the pump, such that in use said valve arrangement is either automatically adjusted when said pump is pumping in the forward direction to selectively connect said first portion of said supply tube to said second portion of said supply tube so as to supply a chemical fluid from the supply container to the pump to be delivered to the manifold, or automatically adjusted when said pump is pumping in the reverse direction to selectively connect said first portion of said supply tube with said feedback tube to draw water from the manifold through the pump to flush said chemical fluid therefrom into the manifold and out of said isolation system.

2. The isolation system of claim 1, wherein during a chemical delivery mode of operation said pump pumps in the forward direction and said valve arrangement connects said first portion of said supply tube to said second portion of said supply tube, thereby enabling delivery of said chemical from said container to one or more destinations within said chemical delivery system.

3. The isolation system of claim 2, wherein said valve arrangement prevents chemical flow through said feedback tube while said pump pumps in the forward direction.

4. The isolation system of claim 3, wherein during a flush mode of operation said pump pumps in the reverse direction and said valve arrangement connects said first portion of said supply tube to said feedback tube.

5. The isolation system of claim 4, wherein said valve arrangement prevents chemical flow through said second portion of said supply tube when said delivery system is flushed with water by running said pump in the reverse direction thereby flushing said first portion of said supply line and said pump with water and preventing water from entering said supply container.

6. The isolation system of claim 1, wherein said valve arrangement comprises:

a first valve provided within said feedback tube; and a second valve provided within said second portion of said supply tube intermediate said junction and said supply container.

7. The isolation system of claim 6, wherein said first valve is closed and said second valve is open during delivery of said chemical from said container to one or more destinations within said chemical delivery system.

8. The isolation system of claim 6, wherein said first valve is open and said second valve is closed to prevent chemical flow through said second portion of said supply tube when said delivery system is flushed with water by running said pump in the reverse direction thereby flushing said first portion of said supply line and said pump with water and preventing water from entering said supply container.

9. The isolation system of claim 1, wherein said valve arrangement comprises a three-way, motor-driven ball valve positioned within said junction, said motor-driven ball valve responsive to a control signal that corresponds to the direction said pump is pumping.

10. The isolation system of claim 9, wherein said ball valve connects said first and second portions of said supply tube and closes said feedback tube during delivery of said chemical from said container to one or more destinations within said chemical delivery system.

11. The isolation system of claim 9, wherein said ball valve connects said first portion of said supply tube to said feedback tube and closes said second portion of said supply tube when said delivery system is flushed with water by running said pump in the reverse direction thereby flushing said first portion of said supply line and said pump with water and preventing water from entering said supply container.

12. A method of flushing a chemical delivery system, said chemical delivery system comprising a supply container connected to a manifold via a supply tube, a feedback tube connected between the manifold and the supply tube at a junction thereof, and a valve arrangement proximate to the junction, the method comprising:

operating a pump in a forward dispensing direction and a reverse flushing direction, including pumping a chemical from a chemical supply container to a delivery manifold when the pump is operating in the forward dispensing direction and drawing water from the delivery manifold when the pump is operated in the reverse flushing direction;

setting said valve arrangement automatically in a first position when the pump operates in the forward dispensing direction, the valve arrangement in the first position fluidly connecting the chemical supply container to the delivery manifold; and arranging the valve arrangement automatically in a second position when the pump operates in the reverse flushing direction, the valve arrangement in the second position fluidly isolating the chemical supply container from delivery manifold and drawing water in the reverse flushing direction so as to flush the chemical from the pump with water from the delivery manifold.

13. The method of claim 12 wherein the valve arrangement fluidly connects the chemical supply container to the delivery manifold through second and first portions of a supply tube when the pump is operating the forward dispensing direction, and the valve arrangement fluidly connects a continuous flush circuit through the delivery manifold, a feedback tube and the first portion of the supply tube when the pump is operating in the reverse flushing direction.

14. The method of claim 13 wherein operating the pump in the reverse flushing direction pumps water through the continuous flush circuit in the reverse flushing direction.

* * * * *